US005403079A

United States Patent [19]

Fetisoff

[11] Patent Number: 5,403,079

[45] Date of Patent: Apr. 4, 1995

[54] PORTABLE ADJUSTABLE BARREL BAR/CABINET

[76] Inventor: Valentine A. Fetisoff, 4819 Ponderosa Dr., Annandale, Va. 22003

[21] Appl. No.: 63,335

[22] Filed: May 19, 1993

[51] Int. Cl.[6] ..... A47B 49/00; A47B 57/30; A47B 64/00

[52] U.S. Cl. ..... 312/204; 312/223.5; 312/249.8; 312/305; 312/326; 312/351.12; 108/25; 248/188.4; 248/188.5

[58] Field of Search ..... 312/204, 249.8, 305, 312/223.5, 326, 238, 351.11, 351 R; 108/25; 248/188.4, 188.5

[56] References Cited

U.S. PATENT DOCUMENTS

| | | | |
|---|---|---|---|
| 401,829 | 4/1889 | Hall . | |
| 516,454 | 3/1894 | Sherman et al. . | |
| 657,463 | 9/1900 | Simpson . | |
| 799,233 | 9/1905 | Hubbell . | |
| 836,947 | 11/1906 | Shidler . | |
| 863,985 | 8/1907 | Haller . | |
| 1,913,387 | 2/1932 | Hayward . | |
| 1,985,412 | 1/1934 | Jackson . | |
| 2,025,416 | 12/1935 | Limerick, Jr. | 312/305 |
| 2,079,225 | 6/1936 | Sabaneeff . | |
| 2,165,426 | 7/1939 | Tuttle et al. | 248/188.5 |
| 2,182,003 | 12/1939 | Roark | 312/305 |
| 2,500,115 | 3/1950 | Burlin . | |
| 2,618,496 | 11/1952 | Johnson | 248/188.4 |
| 3,574,435 | 4/1971 | Barroero . | |
| 4,092,031 | 5/1978 | Greer et al. | 312/351.11 |
| 4,789,121 | 12/1988 | Gidseg et al. | 248/188.4 |
| 4,934,638 | 6/1990 | Davis | 248/188.5 |

FOREIGN PATENT DOCUMENTS

| | | | |
|---|---|---|---|
| 136053 | 4/1948 | Australia . | |
| 952525 | 11/1949 | France . | |
| 218034 | 3/1942 | Switzerland . | |
| 358911 | 1/1962 | Switzerland . | |
| 0000390 | 1/1901 | United Kingdom | 248/188.4 |
| 0769083 | 2/1957 | United Kingdom | 312/305 |
| 0771208 | 3/1957 | United Kingdom | 312/305 |
| 1050255 | 12/1966 | United Kingdom | 312/223.5 |
| 1453850 | 10/1973 | United Kingdom . | |
| 1518172 | 7/1978 | United Kingdom | 108/25 |

*Primary Examiner*—Edward K. Look
*Assistant Examiner*—Christopher Verdier
*Attorney, Agent, or Firm*—Clyde I. Coughenour

[57] ABSTRACT

A portable cabinet or bar, preferably in the shape of a barrel, with table top for stand-up or sit-down sales or for consumption of beverages or playing games etc., is provided with an adjustable height wheel supported base and a rail around its top for easy adjustment and transport. Independently rotatable shelves are supported on shafts within the barrel. The number and location of shelves can be changed or adjusted by insertion and removal through the access door or by telescopic means to accommodate storage of different size and shape objects.

7 Claims, 4 Drawing Sheets

PORTABLE ADJUSTABLE BARREL BAR/CABINET

CROSS-REFERENCE

A Disclosure Document, No. 309024, was filed on May 11, 1992, on the basic concept of the invention under the title "Barrel Bar on Wheels."

BACKGROUND OF THE INVENTION

1. Field of the Invention

The invention is to a new and improved portable barrel-shaped cabinet or bar with adjustable height for use when standing or sitting on a chair or bar stool. Illuminating means and shelves are provided inside the container. The shelves are used as supports for bottles, glasses and/or other receptacles for solids or fluids and can be made adjustable to accommodate different height receptacles or different sized containers.

2. Description of Related Art

Portable exhibit, storage and bar type enclosures have been in use for many years. These cabinets or bars have been manufactured in various sizes and shapes. Many of these cabinets have been provided with shelves of both the stationary and rotary type. As examples: U.S. Pat. No. 799,233, issued 12 Sep. 1905 to H. Hubbell, teaches a cylindrical enclosure or cabinet having rotary shelves that are supported by bearing means that are vertically adjustable on a support shaft; U.S. Pat. No. 516,454 issued 13 Mar. 1894 to M. Sherman et al; U.S. Pat. No. 836,947, issued 27 Nov. 1906 to O. Shidler; U.S. Pat. No. 3,574,435, issued 13 Apr. 1971 to L. Barroero and Australian Patent Specification 136,053, published 8 Apr. 1948 to K. Clayton, all teach containers with rotary shelves therein accessible by door means. L. Barroero also teaches roller bearing supported shelves. British Patent No. 1,453,850, published 27 Oct. 1976 to C. Lye, teaches a barrel-shaped portable bar with shelves and roller provided support means. U.S. Pat. No. 863,985, issued 20 Aug. 1907 to J. Haller, teaches providing illumination for containers.

SUMMARY OF THE INVENTION

The present invention improves on the portable devices of the prior art by providing an easily transportable container or barrel having lower wheels and an upper railing means. The upper railing can be used to transport the container or as a support for towels or other items. The wheel supports are adjustable to select the vertical height of the container upper surface that can be used as a table. Inside the container, an illumination means, that can be activated by a switch that closes the circuit when the door is opened, and rotatable shelves are provided. The container or barrel can be permanently assembled as a unit and the shelves constructed within the container, after the number and location of shelves are determined, by fitting the shelves, shafts and bearing assembly means through the container access door. The shelves, of the lazy Susan type are independently rotatable, and can be vertically adjusted to accommodate different height receptacles. The cabinet can be used as a portable point of sales sit-down or stand-up bar at hotels or convention centers or in private residences as a hide-away bar, card table, refreshment stand, etc.

DESCRIPTION OF THE PREFERRED EMBODIMENTS

Figure 1:
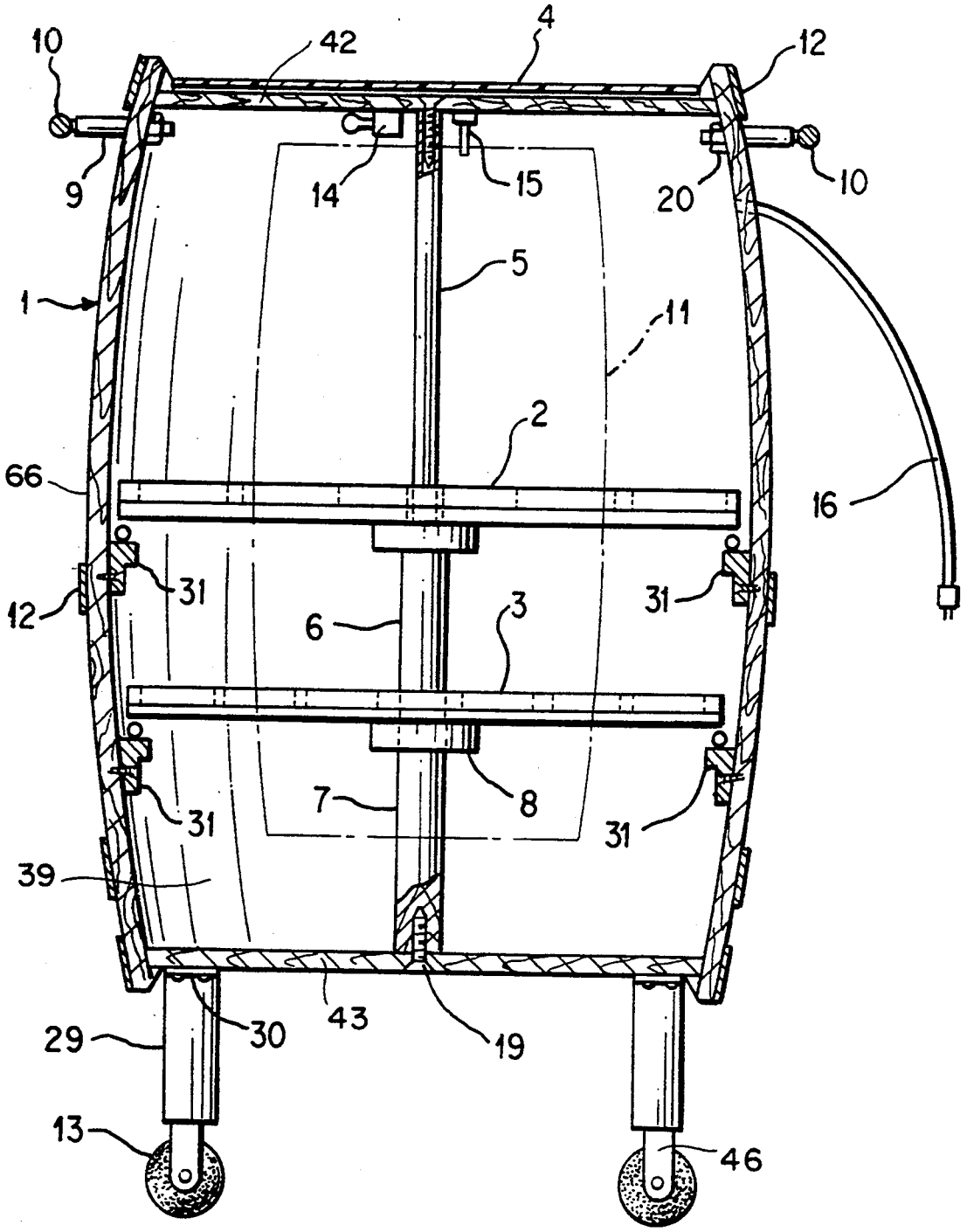
FIG. 1 is an elevational view, partly in section, of a portable cabinet or bar of the present invention.
Figure 6:
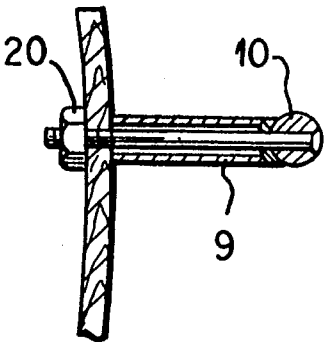
FIG. 6 is a fragmentary sectional view of the rail of the portable cabinet or bar.
Figure 5:
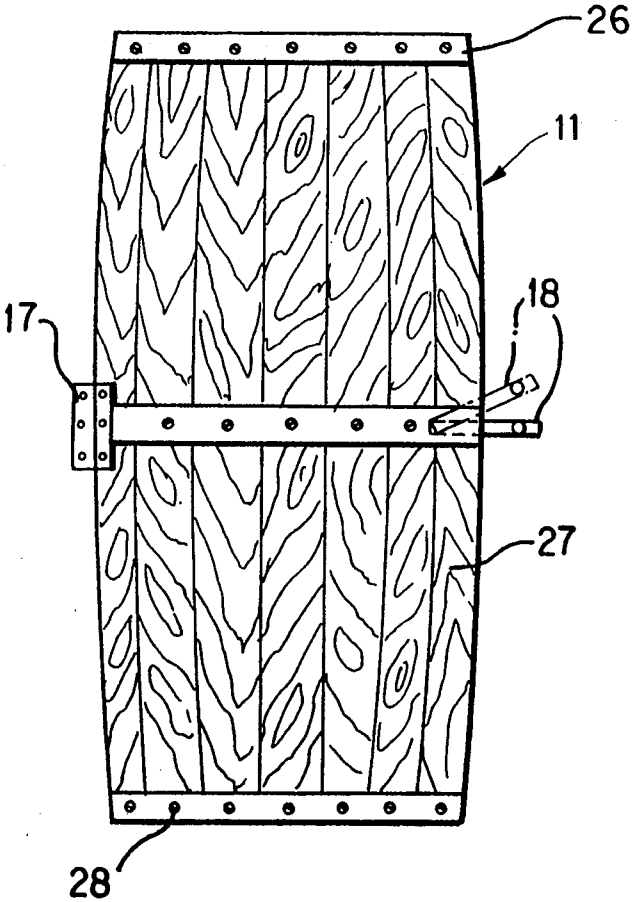
FIG. 5 is a front view of an access door used with the portable cabinet or bar.
Figure 10:
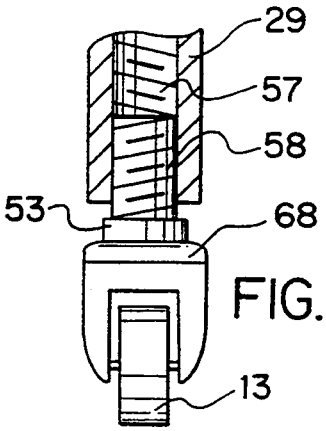
FIG. 10 is a fragmentary side elevation, partly in section, of a wheel support means for the cabinet or bar.

The invention, as shown in FIG. 1, is drawn primarily to an improved portable cabinet or bar 1. A barrel, or container enclosure in the general shape of a barrel, is provided with Lazy Susan type internal shelves 2,3 for ready access of containers or objects placed on or carried by the shelves. The barrel 1 is preferably made of staves 39 with a top 42 and bottom 43. The top can be provided with a formica or other surface or cover 4. The staves 39 are positioned and secured in place with hoops 12. The door 11, in the same general shape and configuration as the barrel 1, provides an access to the inside of the cabinet or barrel. The door 11, as best seen in FIG. 5, is elongated and made from staves or boards 27 held in place by partial hoops or planks 26, and is provided with one or more hinge means 17 and a latch or lock means 18 of any desired conventional design, for opening and closing the door. The cabinet or barrel is preferably made rigid with the sides, top and bottom forming essentially a one piece construction. The top of the barrel is provided with a rail 10 around its entire circumference for moving the barrel and for supporting towels or other objects. The rail 10, as best seen in FIG. 6, is secured to the barrel by nut and bolt means 20 positioned within rail support spacer means 9. The cabinet or barrel 1 is supported on wheels 13 attached to the barrel by wheel extensions 29 attached to wheel supports 46 for easy portability. To adjust the height of the barrel, and in particular the vertical height of the upper surface 4, the wheel supports 46 are adjusted or telescoped within the wheel extensions 29. This can be accomplished by having a threaded connection between the wheel support 46 and extension 29. FIG. 10 shows a threaded telescopic connection 57,58 between a wheel extension 29 and a wheel 13 with the wheel being supported by a common ball bearing wheel pivot means 68. The arrangement permits adjustment so that four people can comfortably sit around the cabinet or barrel and use the top 4 as a table and permits the top 4 to be adjusted level with the floor or the earth. This arrangement also permits stand up use or various height seating, such as with chairs or barstools. The top can be used for games, such as card playing, or for supporting glasses, bottles, etc. A light 14 operated by a switch 15 is provided on the inside that can be activated by opening of the access doors 11. The preferred barrel shape is that in common use for storage and transport of alcoholic beverages such as wines and whiskeys. These barrels have a flat top and bottom with the sides round and a central area 66 of greater diameter than the ends with a gradually increasing diameter from the top and bottom to the central area. This shape accommodates different diameter shelves with larger diameter shelves useable at the central area 66 where the largest or most numerous class of articles can be collected or stored. The larger diameter central area can be made larger enough to extend out as far as or farther than the rail 10 and the support wheels 13 and/or the rail can be constructed close enough to the barrel to not project out further than the barrel central section 66. This can function as a protection as the central barrel will contact an obstacle before the wheels and rail.

Figure 4:
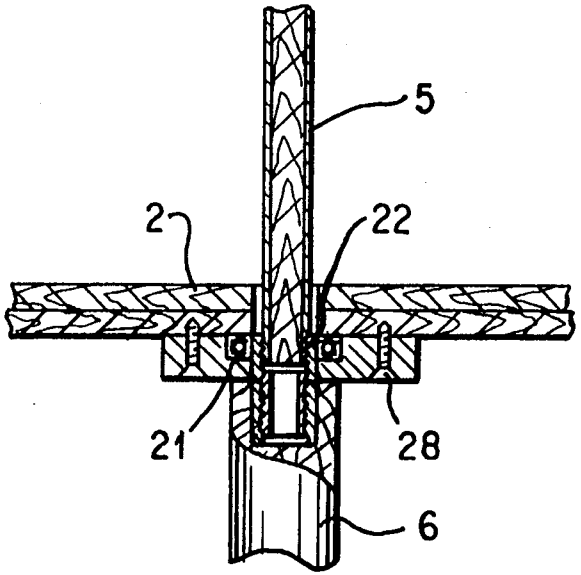
FIG. 4 is a fragmentary cross-sectional view of shaft and bearing means used as a shelf support.

The central support shafts 5,6,7 for the shelves are placed essentially along the center line of the barrel 1 a shown in FIG. 1. They are preferably stationary and the bearing supported shelves 2,3 are preferably independently rotatable. The bearing assembly means 8 can provide the support for the shelves or additional support can be provided at the central area and/or on the inside of the barrel to support the outer base or lower extremity of the shelves. The bearing assembly means 8 are best shown in FIG. 4. The bearing races 21 are vertically positioned with recessed raceways provided for the balls or rollers. The bearing assembly alone is capable of supporting the shelf, but for added support the shaft 6 upper end is positioned under that portion of the shelf bearing assembly means secured to the shelf 2 by screws 28 that protrude inwardly above the shaft upper end, and/or roller or ball means 31 are provided under the shelf outer ends. A thread means 22, is shown that positions the bearings and accommodates the threads on shaft 5.

Figure 3:
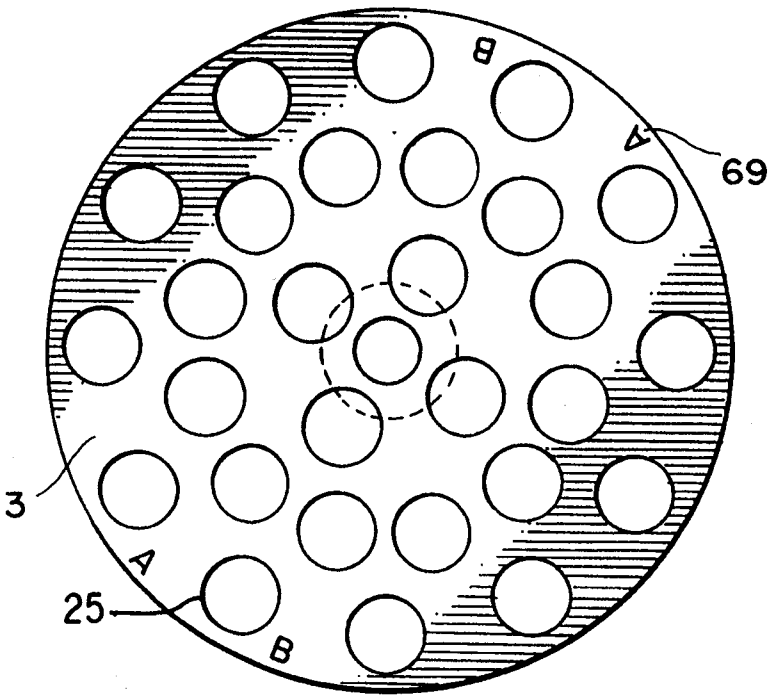
FIGS. 2 and 3 are top views of shelves used in the portable cabinet or bar.
Figure 2:
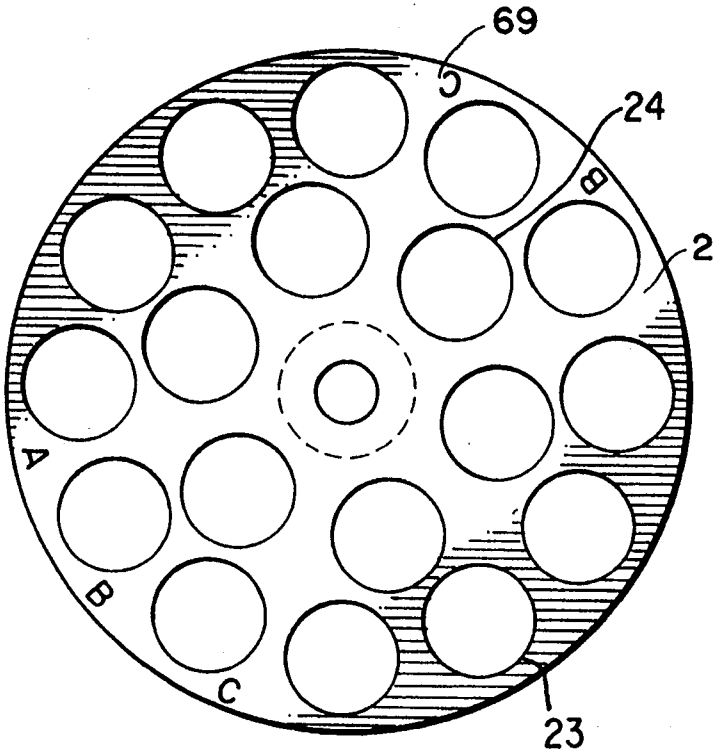

The cabinet or barrel can be made from wood, plastic or a metal, such as stainless steel, or it can be made from an original oak type wine or whiskey barrel. The latter type serves both as an aesthetic antique and as a functional piece of equipment. As one example of the use of the cabinet or bar, a standard size oak wine or whiskey barrel of approximately two to three feet in diameter, can be provided with two rotatable shelves having, for example, 18 and 28 recesses provided respectively in the upper surfaces of the shelves as shown in FIGS. 2 and 3. This could represent, for example, 18 alcohol bottles, in an area having 14 inch headroom, and 28 glasses, with over 6 inches headroom. Other glasses can be stacked on top of the first. With this arrangement there is still over 8 inches vertical room in the bottom area of the barrel. Other size and recess configurations are optional. To assist the user of the shelves to balance the loads placed on each shelf and to reduce wear on the bearings and supports, the recesses 23, 24, 25 can be symmetrically formed around the shelves and each recess A,B, etc. placed opposite another recess A,B, etc. By placing bottles or containers of essentially the same size and weight opposite each other, the load on the shelves caused by a first bottle or container counterbalances that caused by a second. In this manner, a shelf 2,3 will tend to lay flat on the central support 6,7 and evenly distribute the weight on the bearing assembly 8. If there is no counterbalance force, the load will tilt the shelf and place a downward force on the shelf support adjacent the load, with that small point or area acting as a pivot about which the opposite side of the support and shelf will be forced upward. By essentially balancing the loads about the central support, this pivot point and pivotal action created by the imbalanced loads will be eliminated. To assist the user in balancing the load on the central support, opposite recesses can be given the same numbers, letters, color scheme, or other identification 69. A little diligence in balancing the loads enables smaller or weaker bearings and central supports to be used and/or prolongs the useful life of the components. The size or length of the shafts 5,6,7 and the number and arrangements of the recesses 24,25 in the shelves 2,3 can be varied by removal of one set from within the barrel and replacement with another. This removal and replacement is readily permitted by insertion and withdrawal of the screws 19. The shelves can be of one piece wood construction, cut into the preferred shape, or molded plastic or preferably just made from two pieces of plywood. With plywood, recesses can be cut completely through one piece, the top, and the two pieces then secured together. As an example, the bottom pieces can be made from ¼ or ½ inch plywood and the top from ½ or ¾ inch plywood. While the shelves may be rotated by power means, for economy, it is preferred that they be manually rotated. The rail 10 can be made from about ¼ to ¾ inch metal rod or plastic material and attached to the cabinet or barrel with three or more rail supports of about ¼ to ¾ inch tubing 9. The door is small but just large enough for the shelves, the largest individual component forming a part of the cabinet internal structure, to fit through the door diagonally. The cabinet or bar can alternatively be supported on a platform that has the wheels on it. The wheels could also have one central post means with adjustment means located within the central post means. The wheels can be supported on arms that extend outwardly from such a central post means. In place of wheels, rollers or rubber supports may be used under the base. The cabinet or bar can be transported and used without further modification once the initial height and shelf adjustments are made. The cabinet only occupies about three to six square feet of floor space.

Figure 7:
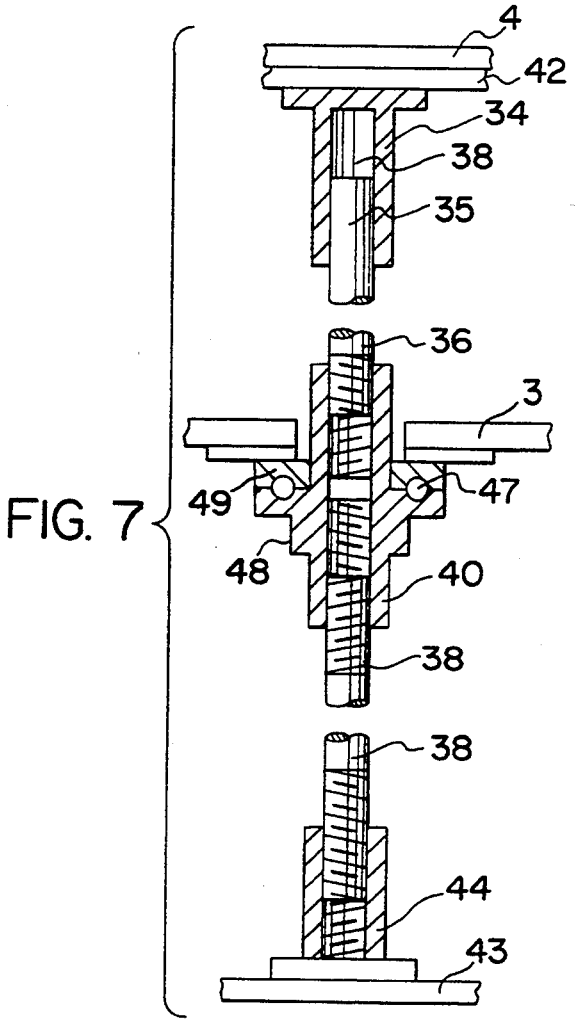
FIG. 7 is a fragmentary side elevation, partly in section, of an alternate shaft and adjustment means for the shelves of the cabinet or bar.
Figure 8:
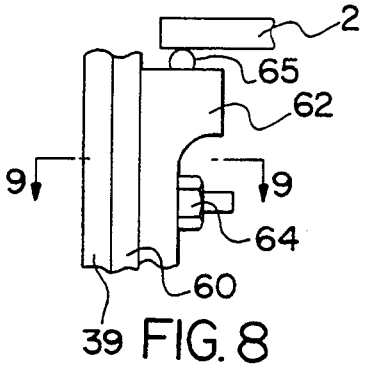
FIG. 8 is a fragmentary side view of an adjustable bearing support for the outer extremity of a shelf.
Figure 9:
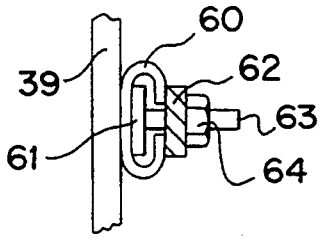
FIG. 9 is a transverse plan sectional view taken along line 9—9 of FIG. 8.

As best shown in FIG. 7, the shelves 2,3 may be made adjustable to accommodate different size containers. While many different means may be used, for simplicity of design and assembly internally, an elongated sleeve 34 is provided on the bottom central portion of the barrel top 42. The top shaft 35 freely telescopes within the elongated sleeve 34 as the shelves are raised and lowered within the cabinet or barrel. The shelves are positioned within the barrel and are raised and lowered by use of threaded coupling or other means. The adjustment of the shelves can be by telescopic threaded coupling means, similar to 57,58, between the central support means 5,6,7,35,36,38 and bearing support means 8,48,49. The threads may be single threads or double or triple threads for faster adjustment. A turnbuckle-type bearing means 40 may be used. The bearing means 40 is provided with horizontal races for roller or ball bearings 47. The lower portion of the bearing means 40 is provided with flats 48 to provide for securement against rotation, using a wrench, while turning the shafts. The upper race 49 of the bearing means 40 is secured to and turns with the shelf. To adjust the lower shelf, either or both of the lower thread means in threaded elongated sleeve 44 and threaded bearing means 40 may be telescoped with respect to the shaft 38. The lower sleeve 44 can be adjusted with respect to the shaft 38 and/or the shaft can be adjusted with respect to the turnbuckle bearing shelf support 40. To secure or support the end of the shelf, support bearing means 62 are provided. Three or more of these supports can be positioned around the lower shelf outer periphery. To provide outer support for the adjustable shelves, the bearing means 62 are also adjustable. The outer bearing support 62, best shown in FIGS. 8 and 9, is provided with a roller or ball bearing 65 or other contact surface on its upper extreme to engage the lower portion of the shelf. The bearing support 62 is held in position by nut 64 and bolt means 63 that extends from a slide plate 61. The plate 61 slides within a channel means 60 that extends vertically along the barrel inner surface. By tightening the nut 64, the bearing support means 62 and channel means 60 are clamped between the slide plate 61 and the nut 64. The bearing support means 62 is then secured to the barrel inner surface. This secures the bearing means at the desired height for supporting the shelf at various adjusted heights within the cabinet or barrel.

Figure 11:
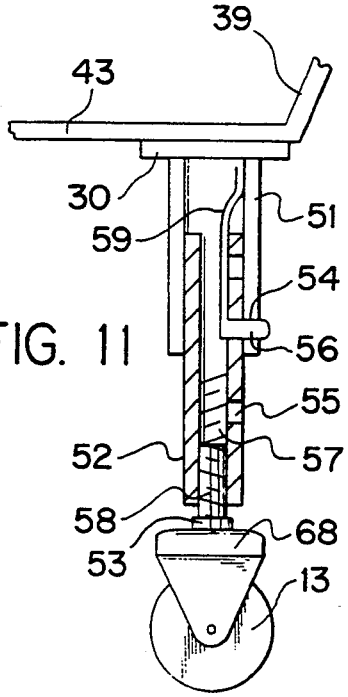
FIG. 11 is a fragmentary side elevation, partly in section, of an alternate adjustable wheel support means of the cabinet or bar.

If the adjustment using a threaded connection alone is not sufficient, as shown in FIG. 11, an intermediate telescoping section 52 can be provided between an upper telescoping section 51 and a lower telescoping section 53. The lower extent of the intermediate telescoping section 52 and the upper extent of the lower telescoping section are provided with threads 57,58 to provide the same adjustment shown in FIG. 10. The upper telescoping section 51 is attached to the cabinet barrel bottom 43 by a plate 30 and is provided with an aperture 54 and a leaf spring 59 loaded pin 56. The intermediate telescoping section 52 is slidable within the upper section 51 and is provided with vertically spaced apertures 55. By sliding the intermediate section 52 within the upper section 51, the aperture 54 and one of the apertures 55 can be aligned so that the spring loaded pin 56 will extend through the apertures and lock the upper and intermediate sections in place to secure the barrel top 42 at its selected height. To assist proper radial alignment of the apertures 54, 55 a tongue and groove may be provided between the upper and intermediate sections 51,52 or a line can be provided on the intermediate section 52 for alignment with a mark provided on the lower extremity of the upper section 51. As with the threaded telescoping means of FIG. 10, the lower portion of the intermediate section 52 and upper portion of the lower telescoping section 53 can be provided with threaded connection means 57,58 for small adjustments and/or leveling. More than one intermediate section and/or spring-loaded pin and aperture set may be provided as necessary. For adjustment, the pin 56 is simply pressed inwardly to release the intermediate section 52 from the upper section 51. The sections are then telescoped or slid to a new position with the selected apertures aligned. The pin will then project into the apertures under the pressure exerted by the spring 59. As shown in FIGS. 10 and 11, the wheels 13 can be supported by commonly used ball bearing pivot means 68, with or without the locking means often used with such pivot means.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

It is claimed:

1. A portable cabinet including:

an enclosure having a top, a bottom and sides;

a door for access to the interior of said enclosure;

shelves within said enclosure for storage;

the intersection of said top and adjacent said sides forming an upper outer extend of said enclosure;

a rail around said upper outer extend of said enclosure;

said rail supported outwardly from said enclosure near said top by spacer means so that said rail can be grasped about its circumference for transporting said cabinet or can be used as a support;

wheel means and wheel support means on said bottom to transport said cabinet;

shaft means for positioning said shelves;

bearing means supported by said shaft means for rotating said shelves;

means for vertically adjusting said shelves within said enclosure;

a bearer support means attached to said enclosure sides for supporting the outer extremities of said shelves;

a channel means vertically positioned on and attached to said enclosure sides;

an attachment means positioned between said channel means and said bearer support means to adjust and position said bearer support means to accommodate adjustments made in the vertical height of said shelves.

2. A portable cabinet including:

an enclosure having a top, a bottom and sides;

rotatable shelves within said enclosure for supporting articles;

adjustment means for vertical adjustment, assembly of and removal of said rotatable shelves within and from said enclosure;

said rotatable shelves adjustment means includes plural support shafts and an upper elongated sleeve, to telescopically position the upper extremity of a top support shaft permitting different adjusted vertical height positions of said shelves;

said rotatable shelves adjustment means includes telescopic connections between said support shafts for adjusting the height of said shelves relative to one another by changing the spacing between said support shafts.

3. A portable cabinet as set forth in claim 2 including:

bearer support means attached to said enclosure sides for supporting the outer extremities of said rotatable shelves;

channel means vertically positioned on and attached to said enclosure sides;

attachment means between said channel means and said bearer support means to adjust and position said bearer support means to accommodate adjustments made in the vertical height of said rotatable shelves.

4. A portable cabinet as set forth in claim 2 including:

wheel means and wheel support means attached to said enclosure bottom;

adjustment means between said wheel and wheel support means to adjust the vertical height of said enclosure top.

5. A portable cabinet as set forth in claim 4 wherein:

said adjustment means between said wheel means and wheel support means are telescopic adjustment means that include apertures and pin means for positioning said telescopic means relative to one another to convert said cabinet from a sit-down type cabinet to a stand-up type cabinet and vice versa.

6. A portable cabinet as set forth in claim 2 wherein:

shelf supporting bearing means are provided for positioning and supporting said rotatable shelves;

said telescopic connections are a part of said bearing means.

7. A portable cabinet including:

an enclosure having a top, a bottom and sides;

shelves vertically spaced within said enclosure;

wheel means supporting said enclosure;

wheel support adjustment means for adjusting the vertical distance between said enclosure top and said wheel means;

said wheel support adjustment means including telescopic sections moveable relative to one another to position said enclosure top so that said enclosure top can be used alternatively as a stand-up-to or sit-down-to table;

said wheel support adjustment telescopic sections include apertures with one of each said sections having plural apertures spaced vertically;

spring-loaded pin means for positioning said telescopic sections relative to one another to adjust said enclosure top for said stand-up-to or sit-down-to position;

thread means between said wheel means and wheel support means for adjusting and leveling said enclosure top with respect to a cabinet support surface to level said top with respect to said cabinet support surface.

* * * * *